United States Patent [19]

Künstle et al.

[11] Patent Number: 4,994,174

[45] Date of Patent: Feb. 19, 1991

[54] PROCESS AND SYSTEM FOR LOW-TEMPERATURE CARBONIZATION OF OIL SHALE, OIL SANDS OR SIMILAR OIL-BEARING SOLIDS

[75] Inventors: Konrad Künstle, Röttenbach; Gerd Brunner, Roth; Jürgen Hoffmann, Nürnberg; Till Dehrmann, Forchheim, all of Fed. Rep. of Germany

[73] Assignee: Siemens Aktiengesellschaft, Munich, Fed. Rep. of Germany

[21] Appl. No.: 453,820

[22] Filed: Dec. 19, 1989

[30] Foreign Application Priority Data

Dec. 21, 1988 [DE] Fed. Rep. of Germany ..... 3843063

[51] Int. Cl.[5] ..... C10G 1/00

[52] U.S. Cl. ..... 208/417; 208/430; 208/434; 201/28; 201/29; 201/30; 201/31; 201/35; 201/36; 201/37; 201/38; 202/96; 202/121; 422/140; 422/187; 422/145

[58] Field of Search ..... 208/417, 430, 434; 422/140, 187, 189, 145; 201/28, 29, 30, 31, 35, 36, 37, 387; 202/96, 121

[56] References Cited

U.S. PATENT DOCUMENTS

| | | | |
|---|---|---|---|
| 2,773,018 | 12/1956 | Parry | 201/36 X |
| 3,018,241 | 1/1962 | Gorin | 208/430 |
| 4,104,129 | 8/1978 | Fields et al. | 201/30 X |

*Primary Examiner*—Curtis R. Davis
*Assistant Examiner*—William C. Diemler
*Attorney, Agent, or Firm*—Herbert L. Lerner; Laurence A. Greenberg

[57] ABSTRACT

A process and system for low-temperature carbonization of oil shale, oil sands and similar oil-bearing solids includes low-temperature carbonization of oil-bearing solids in a high-pressure fluidized bed reactor in the presence of a substance selected from the group consisting of hydrogen and steam at temperatures substantially between 400°and 600° C. for producing low-temperature carbonization gas. The low-temperature carbonization gas is condensed in at least two stages for producing relatively higher boiling and relatively lower boiling oil fractions. The oil-bearing solids are peripherally mashed with the higher boiling oil fraction of the low-temperature carbonization gas, before introducing the oil-bearing solids into the high-pressure fluidized bed reactor. The oil-bearing solids mashed with the higher boiling oil fraction are returned to the high-pressure fluidized bed reactor.

22 Claims, 3 Drawing Sheets

PROCESS AND SYSTEM FOR LOW-TEMPERATURE CARBONIZATION OF OIL SHALE, OIL SANDS OR SIMILAR OIL-BEARING SOLIDS

The invention relates to a process for low-temperature carbonization of oil shale, oil sands or similar oil-bearing solids and to a system for performing the process. The invention is intended to improve the quality and increase the quantity of the oils obtained thereby, to improve the energy balance and to reduce the capital expenditure.

In processes for low-temperature carbonization of oil shale and oil sands which are already known, such oil-bearing solids are carbonized at low temperature with both directly and indirectly supplied heat. In one known process for low-temperature oil shale carbonization, introduced at the Oil Shale Symposium in Rabat, Morocco in April 1984 under the name "Hydrotort", the finely ground oil shale is heated indirectly at an elevated pressure and a gas containing hydrogen is passed through it. It has been found that both the yield and quality of the oil are increased if work is performed with indirectly supplied heat and a hydrogen-containing gas is passed through the oil shale at the same time. Among other reasons, the increase occurs because oxidation of the oil vapors cannot occur due to the reducing atmosphere. Some of the higher boiling hydrocarbons that would otherwise remain in the oil shale can thus be converted by hydrogenation into lower boiling, or in other words more volatile, hydrocarbons. That increases the yield of oils. It is also known that an increase in pressure has a favorable effect on the maximum attainable degree of oil removal.

Moreover, German Published, Non-Prosecuted Application DE-OS 21 04 471 discloses a hydropyrolysis process in which oil shale at between 399° and 816° C. and at a pressure of from 20 to 70 atmospheres above atmospheric pressure is converted with 0.01 to 0.6 tons of water per ton of oil shale in a reactor, and hydrogen-rich gas in quantities of from 156 to 624 $Nm^3$ per ton of oil shale is introduced into the reaction zone for hydrogenizing conversion. The hydrogen-rich gas is recovered from the product stream of the reaction zone and enriched with hydrogen from the conversion of a hydrocarbon material. For conveying purposes, the comminuted oil shale is mixed with water to make a slurry and pumped into the pyrolysis reactor. A particular feature of the process is that large quantities of water per ton of oil shale are needed to generate a pumpable slurry, and such quantities then have to be converted in the reaction zone as well.

It is accordingly an object of the invention to provide a process and system for low-temperature carbonization of oil shale, oil sands or similar oil-bearing solids, which overcome the hereinafore-mentioned disadvantages of the heretofore-known methods and devices of this general type and which provide a way in which the oil yield and the quality of the oil obtained can be even further improved, while at the same time increasing the overall efficiency of the process.

With the foregoing and other objects in view there is provided, in accordance with the invention, a process for low-temperature carbonization of oil shale, oil sands and similar oil-bearing solids, which comprises low-temperature carbonizing oil-bearing solids in a high-pressure fluidized bed reactor in the presence of a substance selected from the group consisting of hydrogen and steam at temperatures substantially between 400° and 600° C. for producing low-temperature carbonization gas; condensing the low-temperature carbonization gas in at least two stages for producing relatively higher boiling and relatively lower boiling oil fractions; peripherally mashing the oil-bearing solids with the higher boiling oil fraction of the low-temperature carbonization gas, before introducing the oil-bearing solids into the high-pressure fluidized bed reactor; and returning the oil-bearing solids mashed with the higher boiling oil fraction to the high-pressure fluidized bed reactor.

The use of low-temperature carbonization of the oil-bearing solids in the high-pressure fluidized bed reactor in the presence of hydrogen and/or steam at temperatures between 400° and 600° C., provides not only is faster heating but also more complete removal of oil from the oil-bearing solids obtained as a result of the fluidizing gas, because of the pronounced increase in surface area. In addition, the reducing hydrogen-containing atmosphere which is used precludes any oxidation. Furthermore, pronounced cracking of the longer carbon chains and saturation of the free valences with hydrogen occur at the relatively high temperature. Since the low-temperature carbonization gas thus obtained is condensed in at least two stages, it becomes possible to return the higher boiling product of condensation of the low-temperature carbonization gas to the high-pressure fluidized bed reactor, and to crack it there once again in the hydrogen or steam atmosphere of the high-pressure fluidized bed reactor. In this way, the proportion of the low boiling oil fraction can be increased in a very desirable way, at the expense of the higher boiling oil fraction. Since the oil-bearing solids are peripherally made into a mash with the higher boiling oil fraction before the introduction of the solids into the high-pressure fluidized bed reactor, and the oil-bearing solids mashed with the higher boiling oil fraction are fed into the high-pressure fluidized bed reactor, the resistance to conveyance of the solids in the supply or delivery line is lowered to a tolerable amount. At the same time, this is in turn the precondition for another feature of the invention described below.

In accordance with another mode of the invention, there is provided a process which comprises feeding the oil-bearing solids mashed with the higher boiling oil fraction to the high-pressure fluidized bed reactor through a supply or delivery line forming an upright column serving as a labyrinth seal with respect to higher pressure in the high-pressure fluidized bed reactor. In this way, expensive valves and pressure gates, which are vulnerable to malfunction, can be dispensed with for the line conveying the solids.

In accordance with a further mode of the invention, there is provided a process which comprises producing the higher boiling oil fraction as a condensation product at substantially between 350° and 420° C. As a result, it is precisely the long-chain hydrocarbons (C20 to C30), which are always difficult to remove, that are repeatedly subjected to the hydrocracking. This reduces the proportion thereof in favor of the lower boiling oil fraction, in a most desirable manner.

In accordance with an added mode of the invention, there is provided a process which comprises preheating the oil-bearing solids to substantially between 150° and 300° C., prior to introduction into the high-pressure fluidized bed reactor. This preheating reduces excessively pronounced condensation of the evaporating oil components on the cooler solids which have already just been introduced into the high-pressure fluidized bed reactor, and permits construction of a smaller-sized actual low-temperature carbonization reactor. A special advantage is that the thermal conductivity of the oil-bearing solids was particularly improved by the mashing process performed beforehand.

In accordance with an additional mode of the invention, there is provided a process which comprises setting an overpressure in the high-pressure fluidized bed in a range substantially between 10 and 150 bar.

The economy of the process is markedly increased if, in accordance with again another mode of the invention, there is provided a process which comprises heating a majority of the fraction of the low-temperature carbonization gas that is gaseous at room temperature, partly cracking the majority of the fraction of the low-temperature carbonization gas in a methane cracking furnace with steam, and feeding the majority of the fraction of the low-temperature carbonization gas into the high-pressure fluidized bed reactor as a carrier gas. In such a case hydrogen gas need not be obtained from outside sources. At the same time, the fraction that is gaseous at room temperature is decreased, in favor of the liquid oil fraction.

In accordance with again a further mode of the invention, there is provided a process which comprises supplying the carrier gas to the reactor at a temperature of substantially between 500° and 650° C.

In accordance with again an added mode of the invention, there is provided a process which comprises admixing hydrogen with at least one substance from the group consisting of steam, carbon monoxide, carbon dioxide, methane and hydrogen sulfide to form the carrier gas.

In accordance with again an additional mode of the invention, there is provided a process which comprises maintaining the fluidized bed, supplying heat, maintaining hydrogenating reaction conditions, and transporting reaction products, with the carrier gas.

With the objects of the invention in view, there is also provided a system for low-temperature carbonization of oil shale, oil sands and similar oil-bearing solids, comprising a high-pressure fluidized bed reactor for low-temperature carbonization of oil-bearing solids and production of low-temperature carbonization gas, at least two condensation stages connected downstream of the high-pressure fluidized bed reactor for condensing the low-temperature carbonization gas and producing relatively higher boiling and relatively lower boiling oil fractions, an outlet line connected to one of the condensation stages for the higher boiling oil fraction, a charging apparatus for the oil-bearing solids connected upstream of the high-pressure fluidized bed reactor, the charging apparatus having a pressure-increasing compressor and an apparatus connected to the outlet line for mashing the oil-bearing solids with the higher boiling oil fraction, and a delivery line connected between the charging apparatus and the high-pressure fluidized bed reactor being sufficiently long to serve as a labyrinth seal for the mashed oil-bearing bearing solids.

This construction of the system permits continuous operation, and produces an extensive conversion of the higher boiling fraction into a lighter oil fraction by recirculation. Moreover, prior to the cracking thereof, the higher boiling fraction is used to improve the thermal conductivity and flowability of the oil-bearing solids.

In accordance with another feature of the invention, the at least two condensation stages include a final condensation stage, and there is provided a product gas line connected downstream of the final condensation stage, a carrier gas line connected to the product gas line, a gas compressor and a methane cracking furnace connected in the carrier gas line, and a connection line connected between the carrier gas line and the high-pressure fluidized bed reactor. As a result, the carrier gas is circulated, and can be supplemented at any time by the continuously generated product gas from the system. Thus nothing needs to be supplied from outside.

In accordance with a further feature of the invention, there is provided a steam line connected to the methane cracking furnace or to a line leading into the methane cracking furnace.

In accordance with an added feature of the invention, there is provided a pressure-increasing compressor built or connected into the outlet line for the higher-boiling oil fraction. This markedly lessens the labor for compressing and transporting the oil-bearing solids through the preheating segment into the high-pressure fluidized bed reactor. At the same time, the preheating of the oil-bearings solids is made easier, because of the improved thermal conductivity. Furthermore, the thermal content of the higher boiling oil fraction is fully exploited for preheating the oil-bearing solids.

In accordance with an additional feature of the invention, there is provided a preheating segment for the oil-bearing solids, being connected between the high-pressure fluidized bed reactor and the apparatus for peripheral mashing.

In accordance with yet another feature of the invention, there are provided means for heating the high-pressure fluidized bed reactor to substantially between 450° and 600° C.

In accordance with yet a further feature of the invention, the at least two condensation stages include a final condensation stage operated at approximately 20° C.

In accordance with yet an added feature of the invention, the at least two condensation stages include a first condensation stage, and there is provided a low-temperature carbonization gas outlet line connected between the high-pressure fluidized bed reactor and the first condensation stage, and a low-temperature carbonization gas/carrier gas heat exchanger system connected in the low-temperature carbonization gas outlet line for heating carrier gas flowing into the high-pressure fluidized bed reactor.

In accordance with yet an additional feature of the invention, the at least two condensation stages include a final condensation stage, and there is provided a product gas line connected downstream of the final condensation stage, a carrier gas line connected to the product gas line, a gas compressor and a methane cracking furnace connected in the carrier gas line, and an externally heated heat exchanger connected in the carrier gas line immediately upstream of the high-pressure fluidized bed reactor.

In accordance with a concomitant feature of the invention, the delivery line conveys a column of oil-bearing solids, the pressure-increasing compressor is a piston compressor having a piston executing a pumping stroke with an end, the piston is disposed in an extreme position at the end of the pumping stroke, and there is provided a retaining plate disposed downstream of the extreme position of the piston in the form of a slide being transversely insertable through the column of oil-bearing solids.

Other features which are considered as characteristic for the invention are set forth in the appended claims.

Although the invention is illustrated and described herein as embodied in a process and system for low-temperature carbonization of oil shale, oil sands or similar oil-bearing solids, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
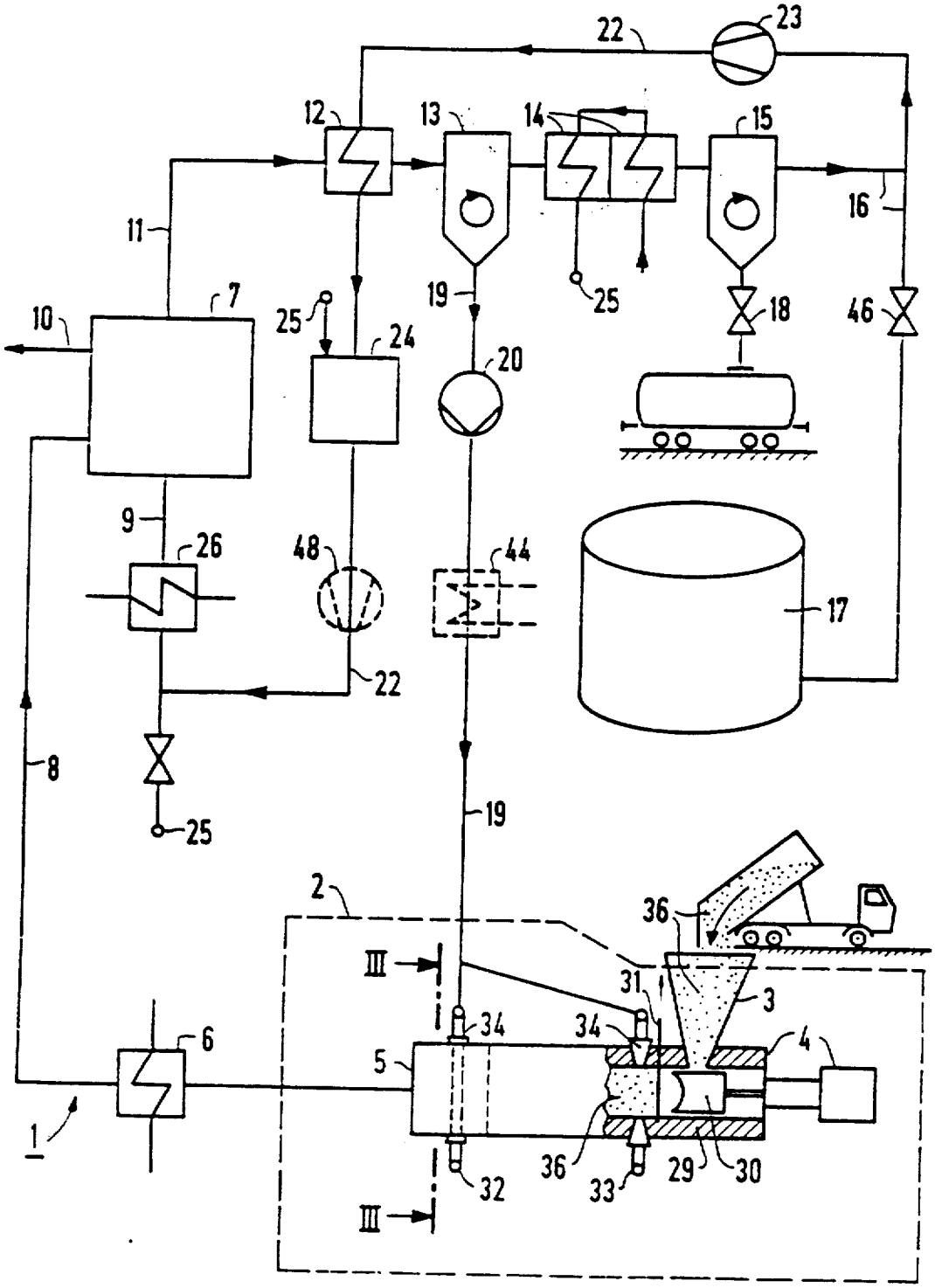
FIG. 1 is a schematic circuit diagram of a system for performing the process according to the invention including perspective, elevational and partly broken-away diagrammatic views of parts thereof.

Referring now to the figures of the drawing in detail and first, particularly, to FIG. 1 thereof, there is seen the overall construction of a system 1 for low-temperature carbonization of oil shale, oil sands or similar solids. The system includes a charging apparatus 2 for the oil-bearing solids, which includes a feed hopper 3, a pressure-increasing compressor 4 and an apparatus 5 for peripheral mashing of the oil-bearing solids. Connected to the charging apparatus 2 is a preheating segment 6 and a high-pressure fluidized bed reactor 7 downstream of the segment 6. Discharging into the high-pressure fluidized bed reactor 7 is a delivery line 8 for the mashed oil-bearing solids, as well as a connection 9 for carrier gas for the fluidized bed which is connected to the lower end of the high-pressure fluidized bed reactor. The upper end of the high-pressure fluidized bed reactor has a discharge line 10 for low-temperature carbonized solid residue and an outlet line 11 for low-temperature carbonization gas. A low-temperature carbonization gas/carrier gas heat exchanger system 12 is connected to the outlet line 11, and a first condensation stage 13 for the higher boiling oil fraction of the low-temperature carbonization gas is in turn connected to the stage 13. The gas side of the condensation stage 13 is connected through a further heat exchanger system 14 to a second and final condensation stage 15 for the lower boiling oil fraction of the low-temperature carbonization gas. The gas side of the condensation stage 15 for the lower boiling oil fraction is connected through a product gas line 16 to a gas reservoir 17. Connected to the lower end of the condensation stage 15 for the lower boiling oil fraction is a filling or racking station 18, which is only schematically illustrated. The first condensation stage 13 is provided with an outlet line 19 for the higher boiling oil fraction. The outlet line 19 is connected through a feed pump 20 to the apparatus 5 for peripheral mashing of the oil-bearing solids dumped into the charging apparatus 2.

In the exemplary embodiment, the product gas line 16 is provided with a branch downstream of the final condensation stage 15. The branch acts as a carrier gas line 22 and leads through a gas compressor 23 and through the low-temperature carbonization gas/carrier gas heat exchanger system 12 into a methane cracking furnace 24. In the exemplary embodiment, a line 25 for supplying process steam also discharges into the methane cracking furnace 24. In the exemplary embodiment, the process steam line 25 is connected to the heat exchanger system 14. The carrier gas line 22 leaving the methane cracking furnace leads into a supplementary heat exchanger 26 and to the connection line 9 for the carrier gas for the high-pressure fluidized bed reactor 7. The supplementary heat exchanger 26 in the exemplary embodiment is electrically heated. After the heating by the gas compressor 23, the heating in the low-temperature carbonization gas/carrier gas heat exchanger system and in the methane cracking oven 24, the supplementary heat exchanger 26 merely serves to fully heat up the carrier gas to a temperature of between 550° and 600° C., which is necessary as a heat input into the high-pressure fluidized bed reactor.

Figure 2:
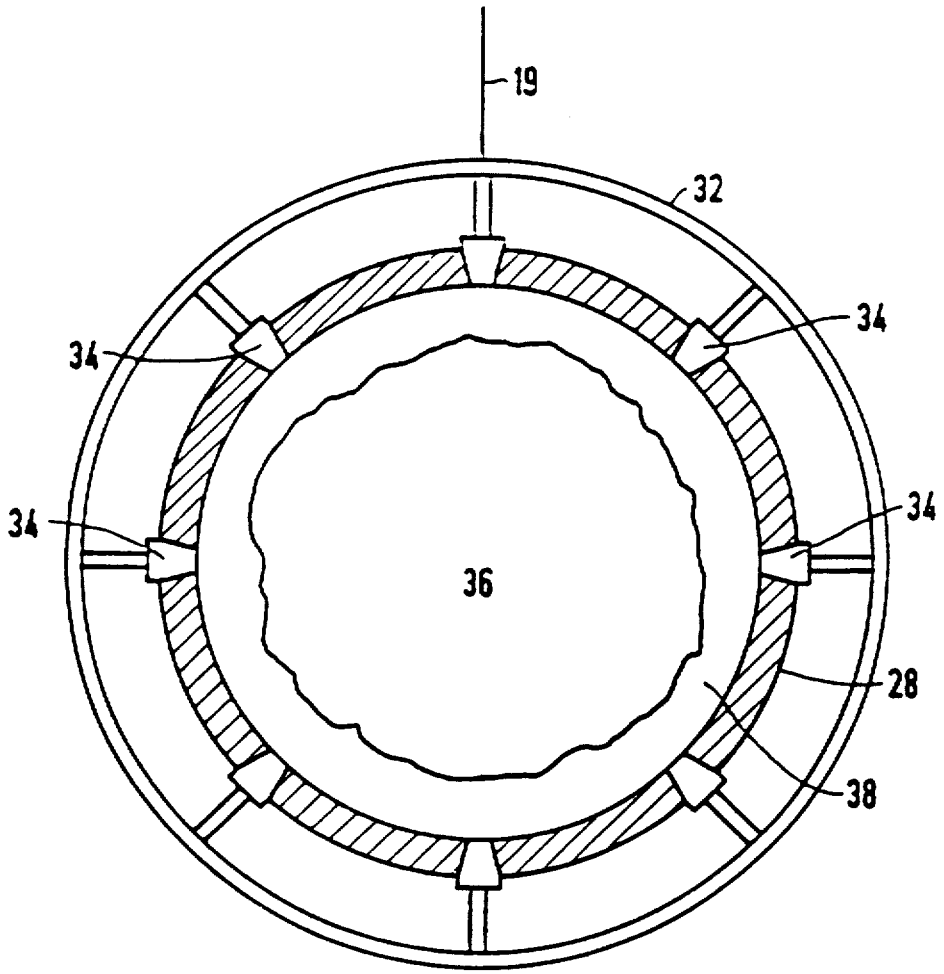
FIG. 2 is an enlarged sectional view taken along the line III—III of FIG. 1, in the direction of the arrows.

The cross section through the apparatus 5 for peripheral mashing shown in FIG. 2 illustrates that the apparatus is substantially formed of a tubular housing 28, which represents an extension of a cylinder 29 in which a piston 30 of the pressure-increasing compressor 4 is displaceable, as shown in FIG. 1. The housing 28 is encompassed by two ring lines 32, 33, to which the outlet line 19 for the higher boiling oil fraction is connected. In the exemplary embodiment, the ring line 32 communicates with eight injection nozzles 34 formed in and distributed about the periphery of the housing 28. It is also shown in FIG. 2 that the higher boiling oil fraction forced in through the injection nozzles only mashes forced-in oil-bearing solids 36 in a peripheral zone 38, along the housing wall.

Figure 3:
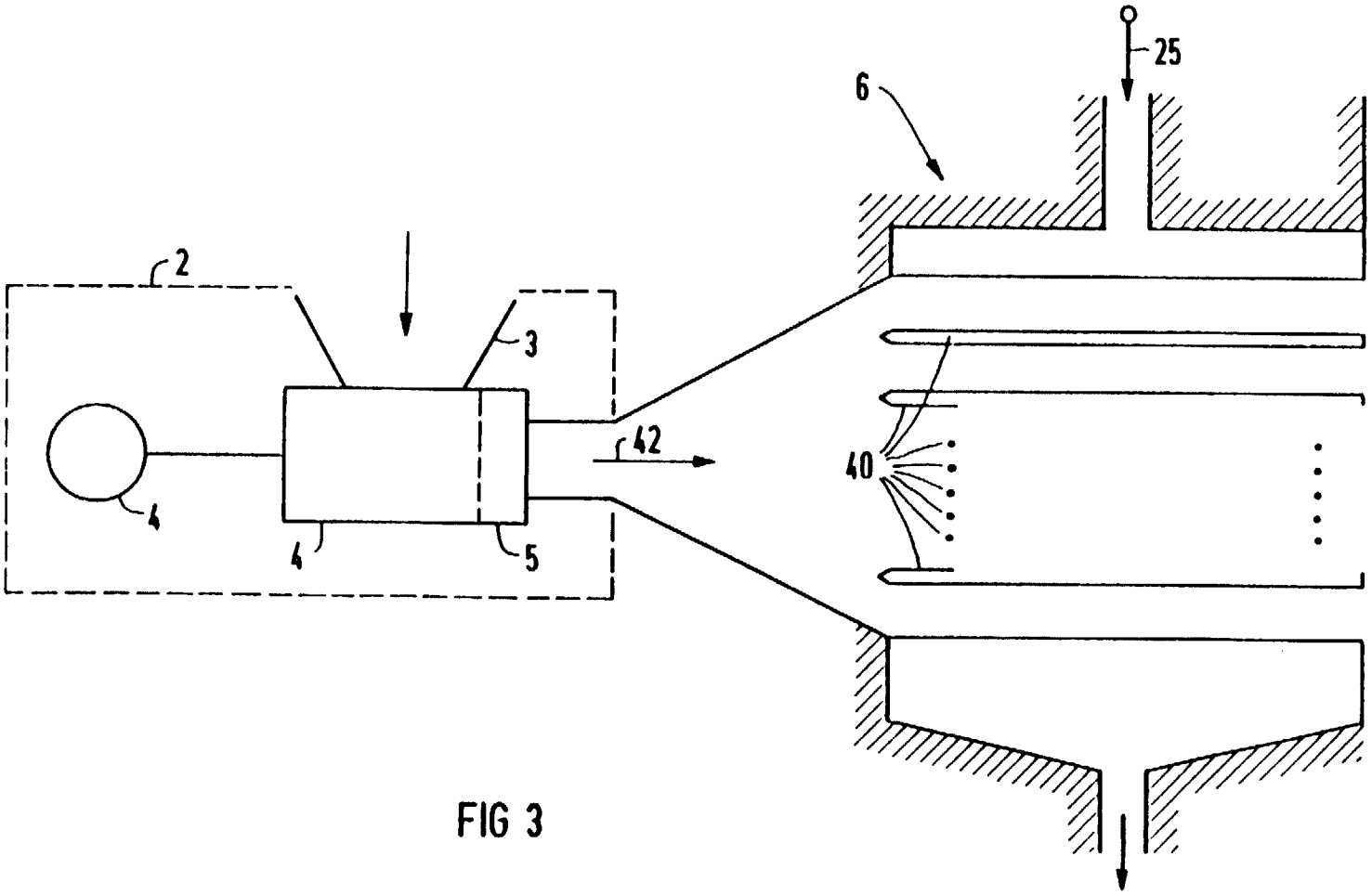
FIG. 3 is a schematic and diagrammatic view of a preheating segment for oil-bearing solids.

FIG. 3 shows the construction of the preheating segment 6 immediately adjacent the charging apparatus 2 for the oil-bearing solids. The preheating segment includes steam-heated, double-walled baffles 40, which are aligned parallel to the direction 42 of conveyance of the solids to be low-temperature carbonized.

During operation of the system 1 for low-temperature carbonization of oil shale, oil sands or similar oil-bearing solids, these substances are fed in comminuted form into the feed hopper 3 of the pressure-increasing compressor 4 and are forced into the mashing apparatus 5 and the preheating segment 6 by the piston 30. At the same time, the feed pump 20 forces the heavy oil fraction into the interior of the housing 28 through the ring lines 32, 33 surrounding the cylinder of the pressure-increasing compressor 4 and the mashing apparatus 5 and through the injection nozzles 34. As shown in FIG. 2, what occurs is a more peripheral mashing of the dry, oil-bearing solids 36. In other words, the peripheral regions 38 of these solids become saturated with oil. In this process the slidability in the vicinity of the circumference of the tube is markedly improved, which reduces the energy required for the pressure-increasing compressor 4. At the same time, the mashing of the oil-bearing solids considerably improves their thermal conductivity.

Due to the improved slidability of the oil-bearing solids, the delivery line 8 for the mashed solids can be made long enough to permit the column of solids located in it to serve as a labyrinth seal, thus rendering a specialized pressure gauge for the solids in the supply line 8 unnecessary. In order to enable a return stroke of the piston 30 without reverse motion of the column of solids in the delivery line 8, a slide plate 31 is merely provided downstream of the extreme position of the piston in the conveying direction. During the return stroke of the piston, the plate 31 prevents the column of solids in the delivery line 8 from sliding backward. The improved thermal conductivity of the column of solids resulting from the mashing also improves the heat transfer between the double-walled, steam-heated baffles 40 of the preheating segment 6 and the mashed oil shale sliding past them. As a result, the expense for the preheating segment is markedly decreased, and more uniform preheating of the oil-bearing solids is attained. At the same time, the delivery of the warm higher boiling oil fraction already provides an initial preheating of the oil-bearing solids. This phenomenon can be even further increased if a further heat exchanger 44 (which is only shown in broken lines) is built into the outlet line for heating the higher boiling oil fraction.

The mashed oil-bearing solid which is preheated in the preheating segment 6 to between 150° and 300° C. arrives in the high-pressure fluidized bed reactor 7, where it is fluidized and further heated by the carrier gas. The carrier gas has a high hydrogen content and flows in at approximately 55 bar through the connection 9 line, at a temperature of from 550° to 600° C. in the exemplary embodiment. The fluidizing of the oil-bearing solids by the carrier gas not only promotes the heat transfer, but also increases the surface area thereof, so that the oil, which is present in capillaries, can evaporate much more easily. Due to the highly reducing atmosphere in the high-pressure fluidized bed reactor 7, not only is any oxidation of the oil vapors prevented, but the saturation of the hydrocarbons when the long carbon chains break off is promoted with hydrogen. The selected high pressure of approximately 50 bar in the high-pressure fluidized bed reactor 7 also reinforces the heat transfer from the carrier gas to the oil-bearing solids and additionally promotes the cracking and saturation of the hydrocarbons with hydrogen. The carrier gas which is used is drawn from the second condensation stage 15, which is operated at approximately 20° C. and, after prior compressing to approximately 55 bar, is forced through the carrier gas line 22 into the methane cracking furnace 24. There a large part of the entrained methane is converted into hydrogen gas, in the presence of the steam fed in through the line 25, in accordance with the following formula:

$$CH_4 + H_2O \longleftrightarrow CO + 3H_2.$$

The gas mixture, which is essentially formed of $H_2$, $H_2O$, CO, $CO_2$, $CH_4$, $C_2H_6$ and $C_2H_4$, can then be heated, without further separation or preparation, in the supplementary heat exchanger 22 to the required temperature of between 450° and 600° 6C. and can be blown as carrier gas into the high-pressure fluidized bed reactor 7. The gas compressor always keeps the pressure of the carrier gas several bar above the pressure in the high-pressure fluidized bed reactor.

The low-temperature carbonization gas flowing out of the high-pressure fluidized bed reactor 7 has a temperature of between 500° and 550° C. in the exemplary embodiment, and is cooled down in the first low-temperature carbonization gas/carrier gas heat exchanger 12. In this process the carrier gas flowing to the high-pressure fluidized bed reactor is heated to approximately 450° to 500°. The low-temperature carbonization gas cooled in this way to approximately 400° C. is then separated from the condensed-out droplets of the higher boiling oil fraction in the first condensation stage 13. The high boiling oil fraction is forced through the feed pump 20 into the apparatus 5 for peripheral mashing of the oil-bearing solids, where it is added through the ring line 32, 33 and the injection nozzles 34 to the oil-bearing unprocessed shale fed into the pressure-increasing compressor 4. In this way the higher boiling oil fraction arrives back in the high-pressure fluidized bed reactor 7, where it is cracked once again. The gaseous products leaving the first condensation stage 13 flow through the further heat exchanger system 14, in which they are cooled down to approximately 20° C., with the simultaneous production of process steam. Thus cooled down, they are carried to the following second condensation stage 15. There, the low boiling oil fraction is separated from the gaseous hydrocarbon compounds. While the low boiling oil fraction is carried to the filling apparatus 18, the gaseous hydrocarbon compounds flow through the product gas line 16 into the carrier gas line 22, and any excess flows through a throttle restriction 46 into a gas reservoir 16.

One feature of this system for low-temperature carbonization of oil shale, oil sands or similar oil-bearing solids is that not only is a very high proportion of the oil contained in the oil-bearing solids recovered, but furthermore, because of the effect of the hydrocracking in the high-pressure fluidized bed reactor, even the light oil fraction is markedly increased, to the detriment of the heavier oil fraction. Due to the recirculation of the higher boiling oil fraction to the high-pressure fluidized bed reactor in each case, virtually all of the heavy oil fraction can be converted into a light oil fraction.

In contrast to the exemplary embodiment described above, it would also be possible to reduce the further heating in the supplementary heat exchanger 26 by decreasing the output of the gas compressor 21 in favor of a further gas compressor 48, which is shown in broken lines and can be built in between the low-temperature carbonization gas/carrier gas heat exchanger system 12 and the supplementary heat exchanger 26.

It would also be possible to operate the high-pressure fluidized bed reactor at an overpressure of only 1 bar. However, since the quantity and quality of the oil yield increases with the operating pressure, operating pressures of between 50 and 100 bar are optimal. At pressures over 150 bar, the expense for apparatus becomes excessive.

We claim:

1. Process for low-temperature carbonization of oil shale, oil sands and similar oil-bearing solids, which comprises:

(1) low-temperature carbonizing oil-bearing solids in a high-pressure fluidized bed reactor in the presence of a substance selected from the group consisting of hydrogen and steam at temperatures substantially between 400° and 600° C. for producing low-temperature carbonization gas;

(2) condensing the low-temperature carbonization gas in at least two stages for producing relatively higher boiling and relatively lower boiling oil fractions;

(3) peripherally mashing the oil-bearing solids with the higher boiling oil fraction of the low-temperature carbonization gas, before introducing the oil-bearing solids into the high-pressure fluidized bed reactor; and (4) returning the oil-bearing solids mashed with the higher boiling oil fraction to the high-pressure fluidized bed reactor.

2. Process according to claim 1, which comprises feeding the oil-bearing solids mashed with the higher boiling oil fraction to the high-pressure fluidized bed reactor through a supply line forming a column serving as a labyrinth seal with respect to higher pressure in the high-pressure fluidized bed reactor.

3. Process according to claim 1, which comprises producing higher boiling oil fraction as a condensation product at substantially between 350° and 420° C.

4. Process according to claim 1, which comprises preheating the oil-bearing solids to substantially between 150° and 300° C., prior to introduction into the high-pressure fluidized bed reactor.

5. Process according to claim 1, which comprises setting an overpressure in the high-pressure fluidized bed in a range substantially between 10 and 150 bar.

6. Process according to claim 1, which comprises heating a majority of the fraction of the low-temperature carbonization gas that is gaseous at room temperature, partly cracking the majority of the fraction of the low-temperature carbonization gas in a methane cracking furnace with steam, and feeding the majority of the fraction of the low-temperature carbonization gas into the high-pressure fluidized bed reactor as a carrier gas.

7. Process according to claim 6, which comprises supplying the carrier gas to the reactor at a temperature of substantially between 500° and 650° C.

8. Process according to claim 6, which comprises admixing hydrogen with at least one substance from the group consisting of steam, carbon monoxide, carbon dioxide, methane and hydrogen sulfide to form the carrier gas.

9. Process according to claim 6, which comprises maintaining the fluidized bed, supplying heat, maintaining hydrogenating reaction conditions, and transporting reaction products, with the carrier gas.

10. System for low-temperature carbonization of oil shale, oil sands and similar oil-bearing solids, comprising a high-pressure fluidized bed reactor for low-temperature carbonization of oil-bearing solids and production of low-temperature carbonization gas, at least two condensation stages connected downstream of said high-pressure fluidized bed reactor for condensing the low-temperature carbonization gas and producing relatively higher boiling and relatively lower boiling oil fractions, an outlet line connected to one of said condensation stages for the higher boiling oil fraction, a charging apparatus for the oil-bearing solids connected upstream of said high-pressure fluidized bed reactor, said charging apparatus having a pressure-increasing compressor and an apparatus connected to said outlet line for mashing the oil-bearing solids with the higher boiling oil fraction, and a delivery line connected between said charging apparatus and said high-pressure fluidized bed reactor being sufficiently long to serve as a labyrinth seal for the mashed oil-bearing solids.

11. System according to claim 10, wherein said at least two condensation stages include a final condensation stage, and including a product gas line connected downstream of said final condensation stage, a carrier gas line connected to said product gas line, a gas compressor and a methane cracking furnace connected in said carrier gas line, and a connection line connected between said carrier gas line and said high-pressure fluidized bed reactor.

12. System according to claim 11, including a steam line connected to said methane cracking furnace.

13. System according to claim 11, including a line leading into said methane cracking furnace, and a steam line connected to said line leading into said methane cracking furnace.

14. System according to claim 10, including a pressure increasing compressor built into said outlet line for the higher-boiling oil fraction.

15. System according to claim 10, including a preheating segment for the oil-bearing solids, being connected between said high-pressure fluidized bed reactor and said apparatus for mashing.

16. System according to claim 10, including means for heating said high-pressure fluidized bed reactor to substantially between 450° and 600° C.

17. System according to claim 10, wherein said at least two condensation stages include a final condensation stage operated at approximately 20° C.

18. System according to claim 10, wherein said at least two condensation stages include a first condensation stage, and including a low-temperature carbonization gas outlet line connected between said high-pressure fluidized bed reactor and said first condensation stage, and a low-temperature carbonization gas/carrier gas heat exchanger system connected in said low-temperature carbonization gas outlet line for heating carrier gas flowing into said high-pressure fluidized bed reactor.

19. System according to claim 10, wherein said at least two condensation stages include a final condensation stage, and including a product gas line connected downstream of said final condensation stage, a carrier gas line connected to said product gas line, a gas compressor and a methane cracking furnace connected in said carrier gas line, and an externally heated heat exchanger connected in said carrier gas line immediately upstream of said high-pressure fluidized bed reactor.

20. System according to claim 10, wherein said delivery line conveys a column of oil-bearing solids, said pressure-increasing compressor is a piston compressor having a piston executing a pumping stroke with an end, said piston is disposed in an extreme position at the end of the pumping stroke, and including a retaining plate disposed downstream of the extreme position of the piston in the form of a slide being transversely insertable through the column of oil-bearing solids.

21. Process for carbonization of oil shale, oil sands and similar oil-bearing solids, which comprises:

(1) carbonizing oil-bearing solids in a fluidized bed reactor for producing carbonization gas;

(2) condensing the carbonization gas for producing oil fractions;

(3) peripherally mashing the oil-bearing solids with one of the oil fractions of the carbonization gas, before introducing the oil-bearing solids into the fluidized bed reactor; and (4) returning the oil-bearing solids mashed with the one oil fraction to the fluidized bed reactor.

22. System for carbonization of oil shale, oil sands and similar oil-bearing solids, comprising a fluidized bed reactor for carbonization of oil-bearing solids and production of carbonization gas, at least two condensation stages connected downstream of said fluidized bed reactor for condensing the carbonization gas and producing oil fractions, a charging apparatus for the oil-bearing solids connected upstream of said fluidized bed reactor, said charging apparatus having pressure-increasing means and an apparatus connected to one of said condensation stages for mashing the oil-bearing solids with one of the oil fractions, and a delivery line connected between said charging apparatus and said fluidized bed reactor being sufficiently long to serve as a labyrinth seal for the mashed oil-bearing solids.

* * * * *

UNITED STATES PATENT AND TRADEMARK OFFICE

CERTIFICATE OF CORRECTION

PATENT NO. : 4,994,174

DATED : February 19, 1991

INVENTOR(S) : Konrad Künstle et al.

It is certified that error appears in the above-identified patent and that said Letters Patent is hereby corrected as shown below:

Column 1, line 20, "Hydrotort" should read -- Hytort --.

Signed and Sealed this

Eleventh Day of August, 1992

*Attest:*

DOUGLAS B. COMER

*Attesting Officer*

*Acting Commissioner of Patents and Trademarks*